US006576278B1

(12) United States Patent
Sprehe

(10) Patent No.: US 6,576,278 B1
(45) Date of Patent: Jun. 10, 2003

(54) RECLOSABLE BABY BOTTLE LINER AND BABY BOTTLE HAVING RECLOSABLE LINER

(75) Inventor: Gregory S. Sprehe, Carbondale, IL (US)

(73) Assignee: Com-Pac International, Inc., Carbondale, IL (US)

( * ) Notice: Subject to any disclaimer, the term of this patent is extended or adjusted under 35 U.S.C. 154(b) by 0 days.

(21) Appl. No.: 09/524,439

(22) Filed: Mar. 14, 2000

(51) Int. Cl.[7] ..... A61J 9/00; B65B 1/04

(52) U.S. Cl. ..... 426/117; 426/130; 215/11.3; 383/63

(58) Field of Search ..... 215/11.2, 11.3; 383/63, 65, 97, 120, 122, 203, 204, 207, 208; 426/87, 117, 112, 130, 801

(56) References Cited

U.S. PATENT DOCUMENTS

| | | | | | |
|---|---|---|---|---|---|
| 3,117,874 | A | | 1/1964 | Horan | 215/11.1 X |
| 3,204,855 | A | * | 9/1965 | Boynton et al. | 229/53 |
| 3,672,122 | A | | 6/1972 | Berger et al. | 53/384 |
| 3,742,950 | A | | 7/1973 | Endrody | 215/11.1 |
| 3,776,408 | A | * | 12/1973 | Wald | 215/11 R |
| 3,790,017 | A | | 2/1974 | Fitzpatrick et al. | 215/11.3 |
| 3,822,806 | A | | 7/1974 | Grimes | 215/11.3 |
| 4,201,299 | A | | 5/1980 | Bumgarner et al. | 383/7 X |
| 4,238,040 | A | | 12/1980 | Fitzpatrick | 215/11.3 |
| 4,339,046 | A | | 7/1982 | Coen | 215/11 |
| 4,466,547 | A | | 8/1984 | Klittich | 215/11.3 |
| 4,501,585 | A | | 2/1985 | Friedman | 215/11.3 X |
| 4,523,377 | A | | 6/1985 | Spletzer et al. | 29/11.3 X |
| 4,558,792 | A | | 12/1985 | Cabernoch et al. | 215/11 R |
| 4,600,104 | A | | 7/1986 | Yanase | 383/35 X |
| 4,686,814 | A | | 8/1987 | Yanase | 383/36 X |
| 4,711,359 | A | | 12/1987 | White et al. | 215/11.3 X |
| 4,869,912 | A | | 9/1989 | McCoy et al. | 426/123 |
| 4,919,983 | A | * | 4/1990 | Fremin | 428/35.7 |
| 4,923,701 | A | * | 5/1990 | VanErden | 426/113 |
| 4,944,418 | A | * | 7/1990 | Wallace | 215/376 |
| D310,417 | S | | 9/1990 | Herritz | D24/48 |
| D315,601 | S | | 3/1991 | McCoy et al. | D24/47 |
| 5,020,680 | A | | 6/1991 | Bale | 215/11.6 |
| 5,167,657 | A | * | 12/1992 | Patel | 604/410 |
| 5,385,251 | A | | 1/1995 | Dunn | 215/11.3 |
| 5,435,864 | A | * | 7/1995 | Machacek et al. | 156/66 |
| 5,983,965 | A | * | 11/1999 | Patrick | 141/391 |
| 6,050,432 | A | * | 4/2000 | Koehnke | 215/11.3 |
| 6,328,082 | B1 | * | 12/2001 | Lafond | 141/313 |

FOREIGN PATENT DOCUMENTS

| | | | |
|---|---|---|---|
| DE | 3727321 | | 3/1989 |
| EP | 0332341 | * | 9/1989 |

* cited by examiner

*Primary Examiner*—Nina Bhat
(74) *Attorney, Agent, or Firm*—Vedder Price Kaufman & Kammholz; Robert S. Beiser, Esq.

(57) ABSTRACT

The present invention includes a baby bottle liner constructed and arranged to fit into a cavity of a baby bottle. The baby bottle liner includes a continuous, profiled, elongated reclosable fastener. The continuous, profiled, elongated reclosable fastener has a first continuous elongated profile strip and a second continuous elongated profile strip. The first continuous elongated profile strip and the second continuous elongated profile strip are dimensioned to provide an airtight and/or watertight seal upon interconnection thereof. The baby bottle liner further comprises an airtight and watertight side seal at each end of the reclosable fastener. Each side seal connects an end of the reclosable fastener to an inside surface of a front wall and an inside surface of a back wall of the liner. The invention also provides a baby bottle with a baby bottle liner and a kit for infant nursing that has a plurality of baby bottle liners. The baby bottle liner can be constructed from a microwavable plastic and also visually indicate that a predetermined safe temperature range has been reached.

25 Claims, 5 Drawing Sheets

RECLOSABLE BABY BOTTLE LINER AND BABY BOTTLE HAVING RECLOSABLE LINER

BACKGROUND OF THE INVENTION

This invention generally relates to baby bottle liners, baby bottles, and a baby bottle having a reclosable plastic liner with properties that permit the liner to be reused.

Nursing pouches and disposable baby bottle liners provide a convenient way for nursing, working mothers to provide nourishment and sustenance for newborns and growing babies. Various studies have shown that there are benefits that accrue from breast feeding babies, and should breast feeding be contraindicated, from feeding children appropriate quantities of nutritious liquids and dietary supplements. However, there are various problems associated with the current technology.

Working mothers need a convenient way to store breast milk and then feed their children at appropriate times. Current baby bottle liners do not provide a way to safely store breast milk while minimizing the risk of external contamination of the milk, and internal bacterial growth. One such exemplary prior art baby bottle and liner is disclosed in U.S. Pat. No. 5,385,251 ("'251 Patent"). The '251 Patent describes a baby bottle liner that provides a reclosable feature at one end of the liner. A serious drawback of this prior art patent involves the risk of contamination of the contents of the liner at the ends of the reclosable fastener and through the fastener itself. The liner of the '251 Patent permits contamination by microbes through the sides of the fastener which are open to the environment. Further, the fastener itself permits air and water to enter the inside of the liner and contaminate the contents thereof. Consequently, a nursing mother may be feeding her child breast milk that may be contaminated with microbes which could cause serious gastrointestinal problems for the child.

Further, the prior art does not solve the problem of how to place an airtight and water tight reclosable string fastener on a liner that is of a size of most liners for baby bottles. Conventional baby bottle liners are generally narrow in width. Hence, placement and sealing of a reclosable fastener onto a liner of narrow width is also a serious problem.

Similarly, Design U.S. Pat. No. 315,601, U.S. Pat. Nos. 3,204,855, 3,672,122, 3,790,017, 3,822,806, 4,238,040, 4,339,046, 4,466,547, 4,501,585, 4,600,104, and 4,896,912 are designed for one time use, yet have a number of serious drawbacks. If the child does not consume the entire quantity of milk held in the liner, the milk must be transferred to another container for storage thereof since the liners were not created to store the unused portion of the milk in a substantially sterile condition. Another drawback of these prior art patents includes that lack of the ability to reuse the liner holder for another beverage. The contents of the liner that are initially held in the liner must be emptied, and the liner disposed of if the holder is to be reused.

Hence, there exists a need to solve the problems in the art that are articulated above.

SUMMARY OF THE INVENTION

Accordingly, it is an object of the invention to overcome the shortcomings of the prior art, and in doing so provide a baby bottle liner constructed and arranged to fit into a cavity of a rigid, conventional baby bottle or holder. The baby bottle liner has a continuous, profiled, elongated reclosable fastener sealed to the inside walls of the liner. The continuous, profiled, elongated reclosable fastener includes a first continuous elongated profile strip and a second continuous elongated profile strip. The first continuous elongated profile strip and the second continuous elongated profile strip are sized and dimensioned to provide an airtight and/or watertight seal upon interconnection thereof.

It is a further object of the invention to provide a baby bottle liner that has an airtight and/or watertight side seal at each end of the reclosable fastener. Each of the side seals connects an end of the reclosable fastener to an inside surface of a front wall and an inside surface of a back wall of the liner.

It is yet a further object of the invention to provide a baby bottle liner that includes a gussetted bottom, and an airtight and watertight seal at the gussetted bottom.

It is another object of the invention to provide a baby bottle liner in which the first continuous elongated profile strip and the second continuous elongated profile strip each have at least two hooks thereon. The hooks on the first continuous elongated profile strip, or optionally the hooks on the second continuous elongated profile strip, are adjacent to each other. In a variant of the invention, at least one of the hooks is at an end of the first continuous elongated profile strip. A second hook of the two hooks is located proximal to the hook at the end of the first continuous elongated profile strip.

It is yet another object of the invention to provide a baby bottle liner that includes a plurality of continuous recesses along a length of each of the profile strips. At least one of the recesses is dimensioned to resealably mate with one of the hooks, in one embodiment of the invention. In yet another embodiment of the invention, at least two of the continuous recesses are dimensioned to resealably mate with the hooks.

It is yet a further object of the invention to provide a baby bottle liner in which at least one continuous recess on each the profile strips is not dimensioned to mate with the hooks, and, in a variant, provide at least one protuberance along a length of each of the profile strips dimensioned to fit securely in the one continuous recess on each of the profile strip not dimensioned to mate with the hooks.

In one variant, at least one of the hooks on the first continuous elongated profile strip is located near the center of the profile strip. In another variant of the invention the hooks are substantially symmetrically distributed on two sides of a center axis of the profile strip.

In yet another embodiment, it is an object of the invention to provide a reclosable fastener that has a plurality of ridges on a back side of each of the profile strips.

Another object of the invention is to provide a baby bottle liner that has infant formula therein. In this variant and other variants of the invention, a top end seal is placed above the reclosable fastener to keep the infant formula hermetically sealed within the liner.

Yet a further object of the invention is to provide a baby bottle with the baby bottle liner described herein, and a kit for infant nursing comprising a plurality of baby bottle liners according to the invention. The kit optionally includes a baby bottle, and/or infant formula.

Another object of the invention includes a baby bottle liner that is constructed from a microwavable plastic, a food grade microwavable plastic, and/or a microwave safe plastic.

In yet another embodiment of the invention, the baby bottle liner includes an additive that changes color when the temperature of the contents of the liner increases or reaches a predetermined temperature range.

It is another object of the present invention to solve these and other problems in the art, and to serve a market that demands hundreds of millions of reclosable plastic baby bottle liners annually. The objects and features of the present invention, other than those specifically set forth above, will become apparent in the detailed description of the invention set forth below and in the drawings.

DETAILED DESCRIPTION OF THE INVENTION

Figure 1:
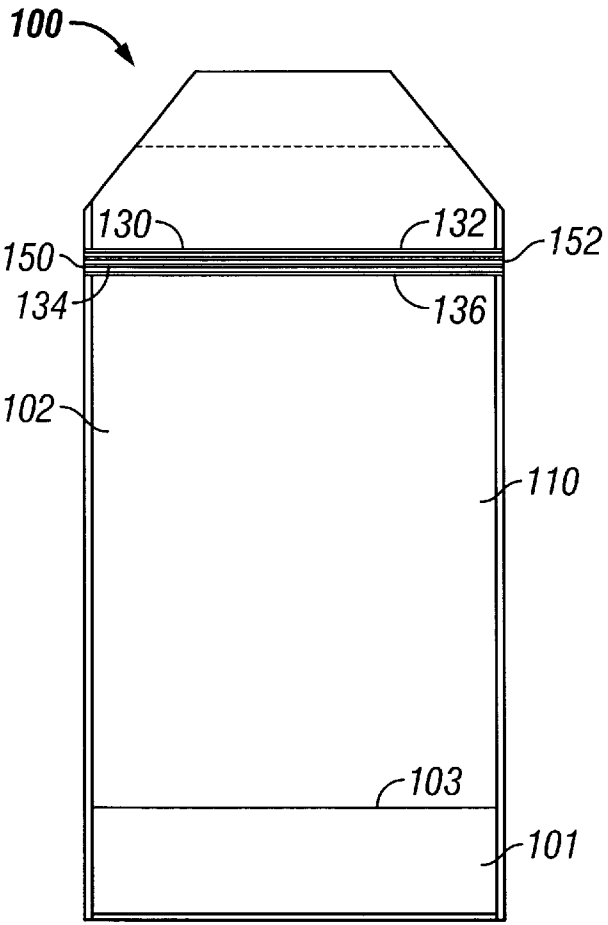
FIG. 1 is a front plan view of a reclosable baby bottle liner of the present invention.
Figure 6:
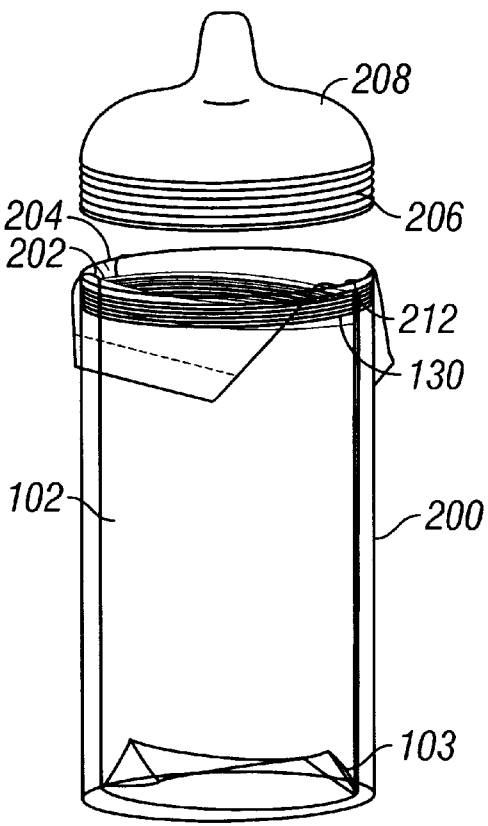
FIG. 6 is a front perspective view of a kit of the present invention having a baby bottle with the baby bottle liner of FIG. 1 therein.

FIG. 1 is a front plan view of reclosable baby bottle liner 100. Liner 100 includes a liner body 102. The baby bottle liner 100 is constructed and arranged to fit into cavity 202 of baby bottle 200 (FIG. 6). It will be appreciated that baby bottle 200 can be made from any suitable material including substantially rigid plastic materials. Baby bottle 200 can have one or two open ends disposed at opposite ends of the baby bottle 200. Liner 100 is constructed to fit over top opening 204 of baby bottle 200, such that cap 206 having nipple 208 can be screwed onto the baby bottle 200 at threads 212. Liner 100 is of a sufficient length L and circumference C such that the portion of the liner 100 having continuous, profiled, elongated reclosable fastener 130 fits over the outside surface 210 of baby bottle 100 such that the liner body is nestled between cap 206 and threads 212. While the variant of the invention shown in the figures illustrates threads 212 mated with cap 206, various types of mounting and securing methods can be used other than those described herein. In another variant, cap 206 is placed directly over reclosable fastener 130.

Continuous, profiled, elongated reclosable fastener 130 includes first continuous elongated profile strip 136 and a second continuous elongated profile strip 138. An important aspect of the invention is the fact that the first continuous elongated profile strip 136 and the second continuous elongated profile strip 138 are dimensioned to provide an airtight and watertight seal upon interconnection thereof. The airtight and/or watertight seal provide the important function of keeping foreign material including bacteria, molds, and viruses from entering the interior of liner 100. Further, this seal starves any bacteria or other microbes inside the contents of the liner of oxygen, thus destroying the ability to replicate exponentially. Hence, the risk of deadly contamination of the milk in the liner is greatly reduced. Various types and configurations of reclosable fasteners can be used with the present invention as long as they provide the functionality of being airtight and/or water tight.

Figure 3:
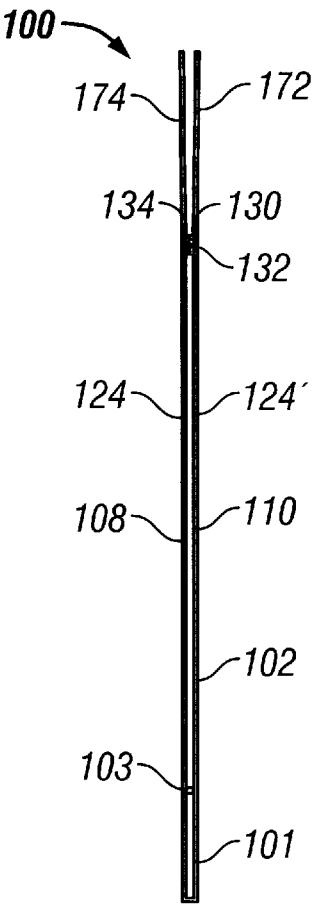
FIG. 3 is a side cross sectional view of the liner of FIG. 1.
Figure 2:
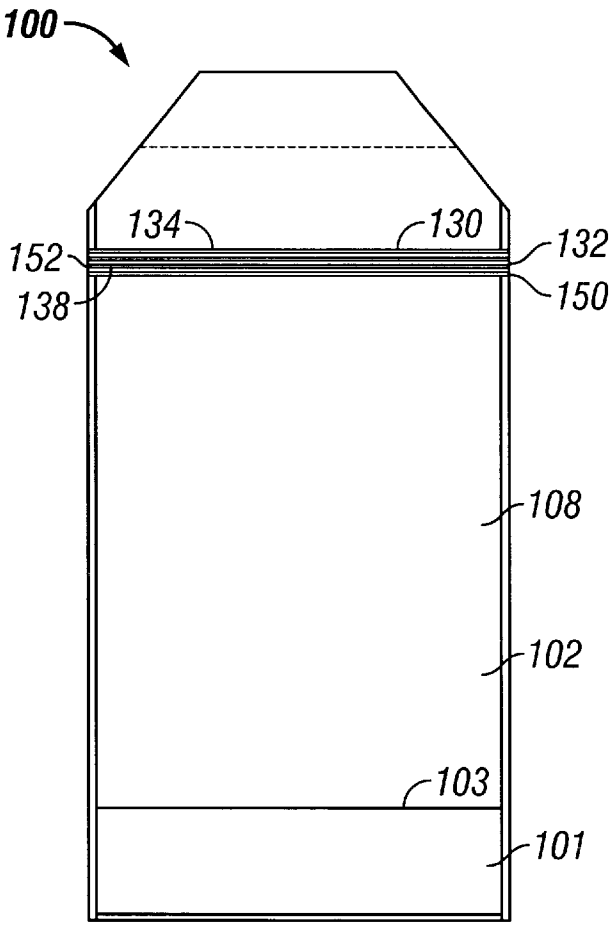
FIG. 2 is a back plan view of the liner of FIG. 1.

Also important to the invention is that baby bottle liner 100 includes airtight and/or watertight side seals 150, 152 at each end of said reclosable fastener, each said side seal 150, 152 connects an end of said reclosable fastener to an inside surface of a front wall 108 and an inside surface of a back wall 110 of liner 100. At each end 132, 134 of the reclosable fastener assembly 130 is an airtight and watertight side seal 150, 152. Each side seal 150,152 connects end 132, 134 of the reclosable fastener assembly 130 to an inside surface 124 of front wall 108 and an inside surface 124 of back wall 110 (as seen in FIG. 3). Any of the seals described herein can be made by a variety of devices including heat sealers, ultrasonic sealers, and other devices known in the art. The seals also may be made with a food grade adhesive.

In one variant of the invention, baby bottle liner 100 includes gussetted bottom 101, and an airtight and/or watertight seal 103 at gussetted bottom 101. The invention also contemplates placement of side gussets on liner 100 (not shown).

As stated above, liner 100 includes reclosable fastener 130. Reclosable fastener assembly 130 includes two ends 132, 134. Between ends 132, 134, a first continuous elongated profile strip 136 is releasably interlocked with a second continuous elongated profile strip 138. It is appreciated that first continuous elongated profile 136 and the second continuous elongated profile 138 can have any type of protruding male and female members which when interlocked provide an airtight and/or watertight seal.

Figure 9:
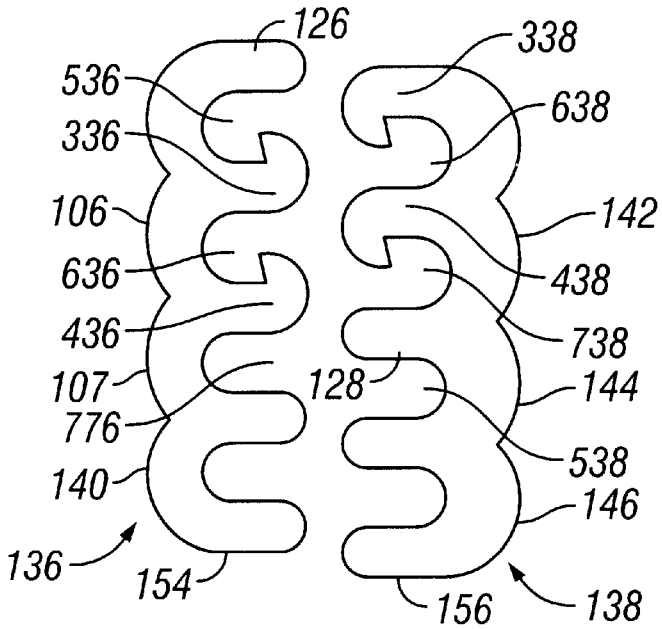

In a preferred embodiment of the invention, a particular type of reclosable fastener 130 has been found to provide a particularly durable airtight/water tight seal for use in the present invention. Fastener 130 includes first continuous elongated profile strip 136 and second continuous elongated profile strip 138 which each have at least two hooks 336, 436, 338, 438 thereon (as seen in FIG. 9). First continuous elongated profile strip 136 has hooks 336, 436. Second continuous elongated profile strip 138 has hooks 338, 438 hooks thereon. While only two pairs of hooks 336, 436, 338 and 438 are constructed and arranged on profiles 136, 138 in the variant shown it is appreciated that a greater or lesser number of hooks can be used as desired, with a corresponding increase in width of the strips 136, 138.

Preferably, hooks 336, 436 on first continuous elongated profile strip 136 are adjacent to each other. Optionally, hooks 338, 438 on second continuous elongated profile strip 138 are also adjacent to each other in one variant of the invention. As shown in FIG. 9, at least hook 336 is at an end of first continuous elongated profile strip 136. Second hook 436 is located proximal to hook 336.

In one variant of the invention, first continuous elongated profile strip 136 has a plurality of continuous recesses 536, 636, 776 along a length of strip 136 (FIG. 9). Second continuous elongated profile strip 138 has a plurality of continuous recesses 538, 638, 738 along a length of strip 138. Of course, it is appreciated that any number of recesses can be created along strips 136, 138, including but not limited to more than three recesses and less than three recesses, with a corresponding increase/decrease in corresponding hooks and other members. In one variant of the invention, at least one of the recesses is dimensioned to resealably mate with one of hooks. As illustrated in FIG. 9, recesses 536 and 636 are substantially congruent to hooks 338, 438 such that when hooks 338, 438 are releasably interlocked into recesses 536, 636 a secure water tight and/or airtight seal is created. Similarly, recesses 638 and 738 are substantially congruent to hooks 336, 436 such that when hooks 336, 436 are releasably interlocked into recesses 638, 738 a secure water tight and/or airtight seal is also created. It is appreciated that while the geometry and arrangement of the various recesses and hooks described herein generally relates to a hook and a substantially congruent recess to the hook, a variety of suitable geometries or configurations of the male members and female members are disclosed subject only to the condition that the seal made when the profiles are interlocked is airtight and/or water tight. It is further appreciated that the present invention provides a reclosable fastener with a plurality of airtight and/or watertight seals between corresponding members of the profile strips 136, 138.

It is further appreciated that, preferably, at least two continuous recesses 536, 636 are dimensioned to resealably mate with hooks 338, 438, and/or at least two continuous recesses 638, 738 are dimensioned to resealably mate with hooks 336, 436.

In another variant of the invention, at least one continuous recess on each respective profile strip is not dimensioned to mate with a respective hook, but rather dimensioned to tightly fit into a recess that is substantially congruent to a profile member. It is appreciated that when member 126 is inserted into recess 538, the tight fit between member 126 and recess 538 also creates an additional substantially water tight and/or airtight fit. The interaction between the other recesses and members causes a similar result with the combination of the interaction of the various hooks, recesses, and members creating a substantially leak-proof failsafe seal. Of course, it is further appreciated that while the geometry of the members is as shown in the FIGS. 8 and 9, any type of geometry or configuration can be used, e.g. a rectangular geometry, a triangular geometry, etc. The profile of the present invention provides for at least one protuberance along a length of each profile strip 136, 138 dimensioned to fit securely in one of the continuous recesses on each profile strip 136, 138 not dimensioned to mate with the hooks.

As further seen in FIG. 9, a plurality of ridges 106, 107, 140, 142, 144, 146 are located on back sides 154, 156 of each of profile strips 136, 138. Ridges 106, 107, 140, 142, 144, 146 provide a suitable way to obtain an airtight and/or water tight seal of back sides 154, 156 to inside surface 124 of the liner body 102 at front wall 108 and back wall 110.

As shown in FIG. 9, at least one of hooks 338, 438 on first continuous elongated profile strip 138 is located near center axis C of profile strip 138. In this variant of the invention, one or more hooks 338, 438 are substantially symmetrically distributed on two sides of center axis C of profile strip 138. Having the various hooks, recesses, and members constructed and arranged as described herein allows for an airtight and/or watertight seal.

Figure 5:
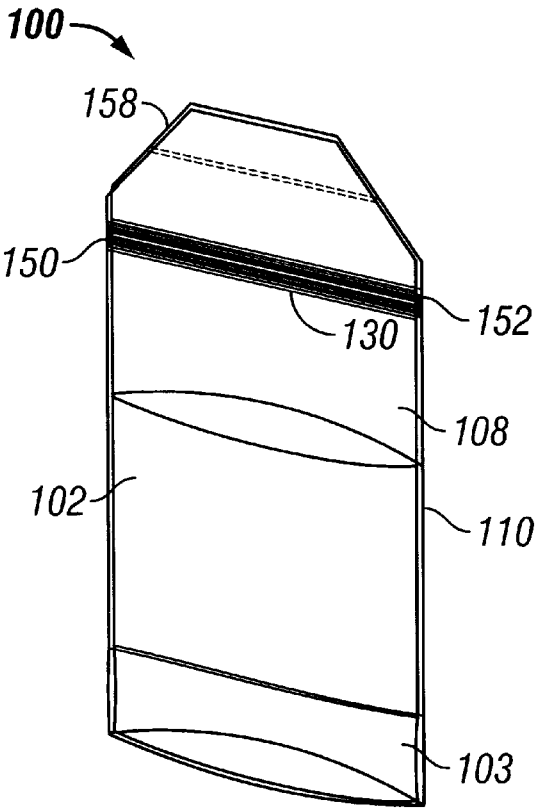
FIG. 5 is a front perspective view of the baby bottle liner of FIG. 1 including infant formula and a top end seal above the reclosable fastener.
Figure 4:
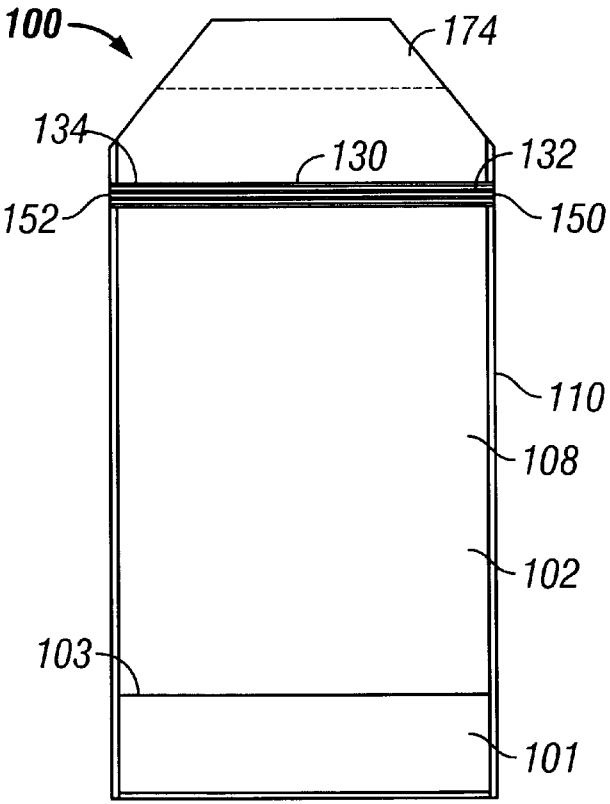
FIG. 4 is a front plan view of the liner of FIG. 1 through a side seal of the liner.

Optionally, baby bottle liner 100 can also have infant formula or other nutritional supplement or drink within liner body 102 (FIG. 5). In this scenario, the airtight and/or watertight seal formed with reclosable fastener 130 is particularly helpful as the contents are hermetically sealed within the liner body 102 until they are ready for use. Top end seal 158 can also optionally be added above reclosable fastener 130 to reduce the risk of contamination of the contents of the liner body 102.

Figure 7:
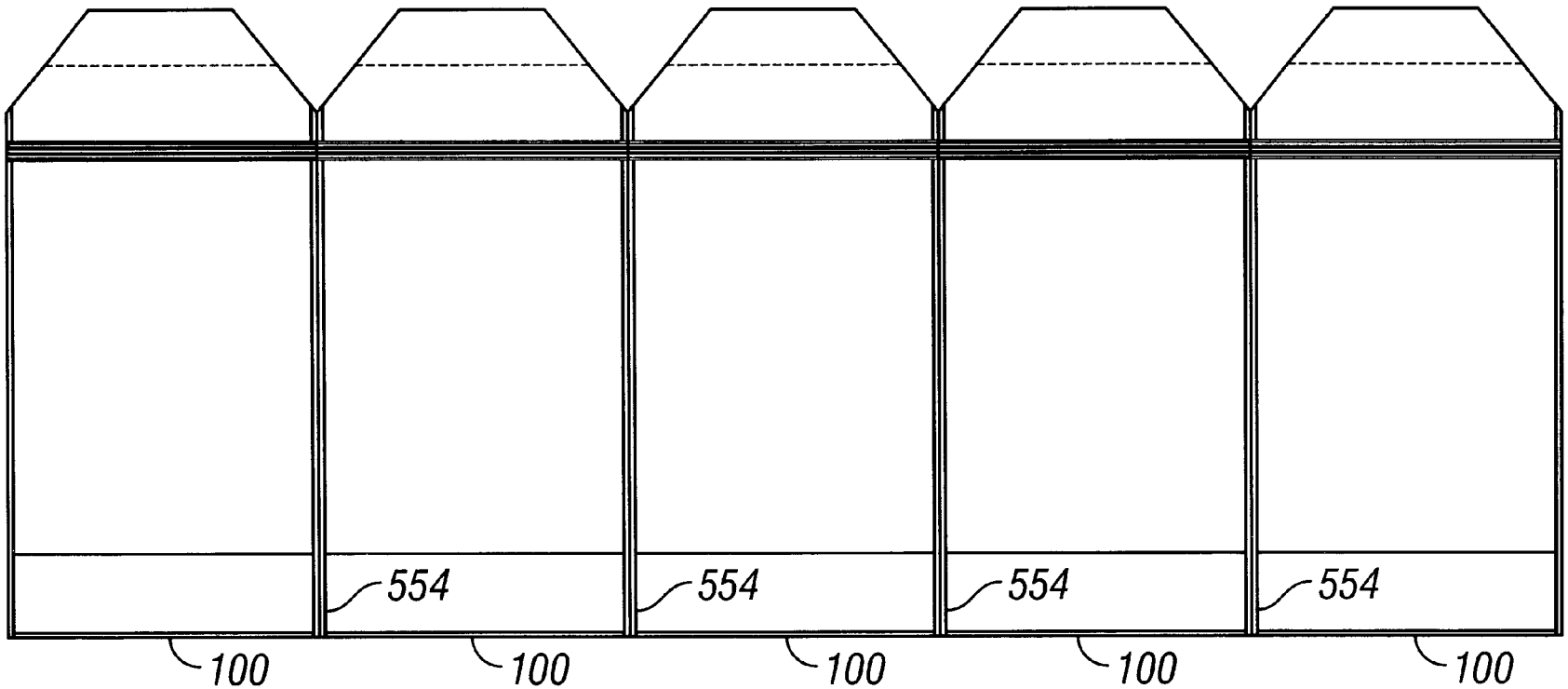
FIG. 7 is a front perspective view of a plurality of chain of baby bottle liners according to FIG. 1.

It is appreciated that liner 100 of the present invention is used with baby bottle 200 and located within a cavity 202 therein (FIG. 6). In addition to being used with baby bottle 200, the present invention provides kit 550 for infant nursing which is composed of a plurality of baby bottle liners 100 (FIG. 7). Each baby bottle liner 100 can be dispensed from a roll of baby bottle liners 100 by being removably connected to one another and detached from one another by a frangible connection between each respective liner 100 such as a perforation 100A or other suitable means. Alternatively, the kit 100 can also be composed of individual liners 100 which can be packed within a box or other appropriate container (not shown) such that a nursing mother can readily have access to liners 100 as the need arises. In another variant, each individual liner 100 or a plurality of liners 100 can be hermetically sealed within a non-reclosable plastic bag (not shown) that may be torn open as the need arises. Kit 550 can also include formula, nutritional drinks, baby bottle nipples, one or more baby bottles 200 of various sizes and/or liners 100 of various sizes, sized, arranged and constructed with kit 550 for ease of access and use with respective baby bottles 200.

Yet another variant of the invention provides liner 100 that is constructed of a food grade microwavable plastic or a microwavable coating(s) that permits the contents of the liner body 102 to be placed in a microwave for re-heating of the contents to a suitable temperature. It is appreciated that this feature of the invention permits several of the most common problems associated infant nursing to be solved, e.g. re-use and re-heating of mother's milk or infant formula. It is also appreciated that the plastic is chosen to eliminate or minimize any leaching that may occur. Various types of food grade, microwavable plastics are known and commercially available in the industry, but they have not been used with bottle liners as in the present invention. One such suitable microwavable material is a film comprising Kraton™ polyolefin block co-polymers that are commercially available from Shell Chemical Products. Materials made with or comprising Kraton™ polymers also have the additional advantage that they are steam sterilizable or sterilizable by other conventional methods.

The liner 100 also optionally comprises an additive that is extruded with liner 100. The additive changes color when the temperature of the contents of the liner increases or turns a predetermined color when the contents of the liner 100 are at a suitable temperature. Liner 100 may also optionally have a temperature indicator or temperature range indicator associated with the liner 100, e.g. connected thereto or placed as a strip on or in liner 100 that changes color when the temperature of the contents of the liner increases or reaches a predetermined desirable temperature or temperature range. This feature solves the common problem of providing the infant formula or mother's milk at an appropriate temperature that is neither too hot nor too cold for the child. This feature of the invention permits the temperature of the contents of the liner 100 to be visually determined prior to infant nursing.

Figure 8:
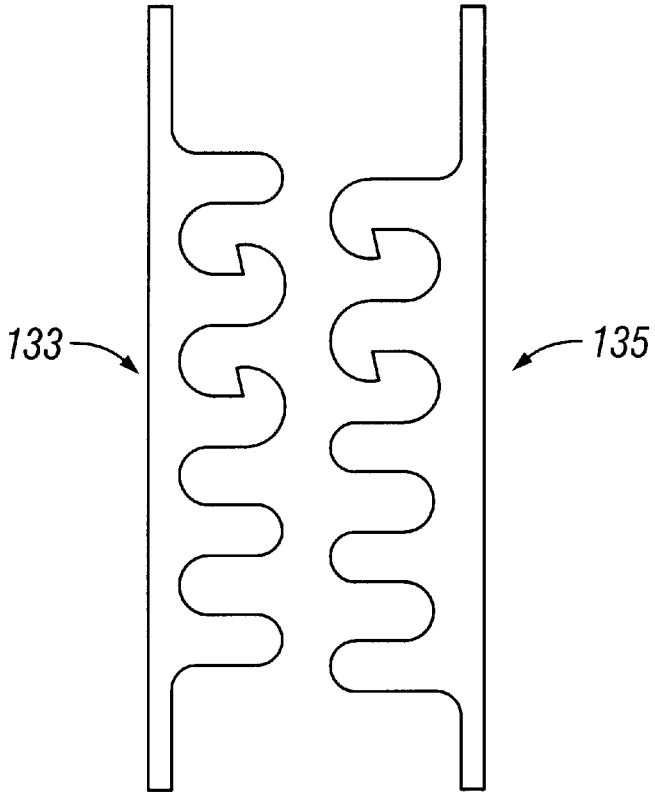
FIG. 8 is a side cross sectional view of the baby bottle liner of FIG. 1 having a continuous, profiled, elongated reclosable fastener that is a flanged reclosable fastener; and, FIG. 9 is a side cross sectional view of a reclosable fastener used with the baby bottle liner of the present invention.

While the embodiment of the invention shown in FIG. 9 illustrates a reclosable fastener 130 that is a string zipper, it is also appreciated that reclosable fastener 130 can also include a flanged reclosable fastener 131 (FIG. 8). Flanged reclosable fastener 130 comprises at least two flanges 133, 135. Flanges 133, 135 are sealed to front wall 108 and/or back wall 110 of baby bottle liner 100 with airtight and/or watertight flange seals 137, 139. It is appreciated that by providing flanges 133, 135, the problems associated with sealing an irregularly shaped surface, e.g. a zipper profile, to a smooth surface are eliminated. The flange 133 and flange 135 provide a substantially smooth, planar and uniform surface to which to seal the inside surface 124 and walls 108, 110 of liner body 102. To improve the appearance and air and water-tightness of liner 100, it is preferred that the length L of the reclosable fastener assembly 130 is less than the width W of back wall 110 (FIG. 1).

In a variant of the invention, liner 100 includes a frangible access 155 (FIG. 5). Access 155 can take many forms including a crease line, a score line, or a plurality of perforations. Preferably, access 155 is substantially parallel to the reclosable fastener assembly 130 or access 155 may be sinusoidally shaped from aesthetic purposes. Removal of access 155 exposes the releasable fastener assembly 130 and provides access to the reclosable fastener 130. One feature of the invention is that frangible access 155 is located both on the front wall 108 and on the back wall 110 of the liner body 102 adjacent the reclosable fastener assembly 130 and above the top end seal 158 (FIG. 5). In a preferred embodiment, frangible access 155 comprises a plurality of perforations 157.

The film from which liner body 102 is constructed can be made from any suitable material, but is preferably made from a polymeric material as long as it is food grade and compatible with the contents of the liner 100. The film is folded and sealed such that bottom gussets 101 are created in a conventional manner. Optionally, side gussets (not shown) are also added to liner body 102. It is appreciated that the gussetting feature increases the overall carrying capacity of the liner 100 and makes the bottle 200 with liner 100 generally more stable where the entire bottle is filled with formula and the like.

The seals used in the present invention can be made using conventional sealing techniques, which include by way of example heat sealing, ultrasonic sealing, adhesive sealing, etc. To aid in the formation of the airtight and/or watertight seals used in the present invention, it is appreciated that the length L of the reclosable fastener 130 is less than the length of front wall 108 and/or back wall 110 that form liner body 102.

Figure 10:
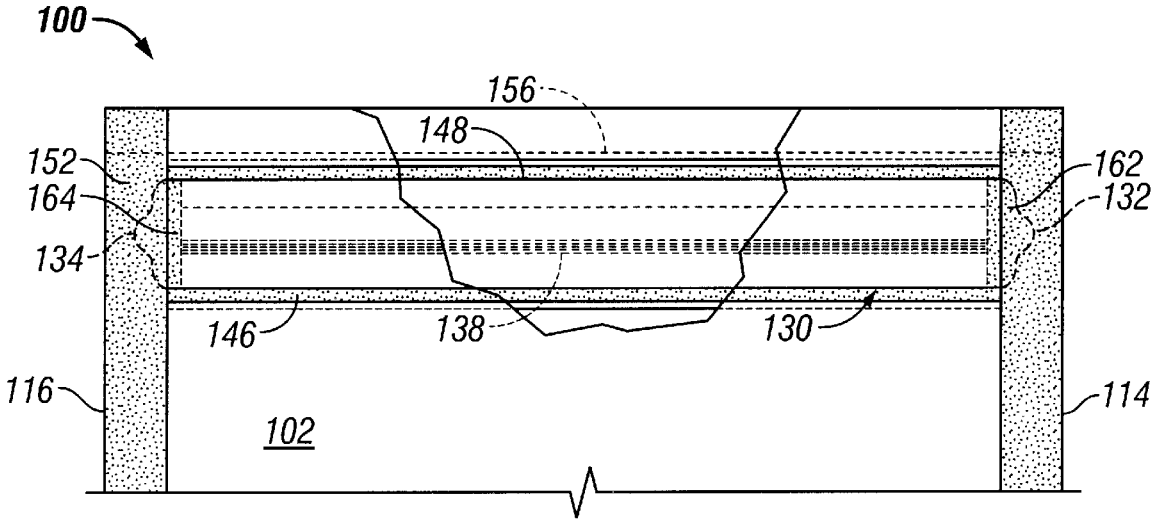
FIG. 10 is a front partial cross sectional plan view of the baby bottle liner of FIG. 1 including the top end seal above the reclosable fastener.

As seen in FIG. 10, side seals 150, 152 are placed at each end of the reclosable fastener assembly 130. Side seals 150, 152 provide an airtight and/or watertight seal between the inside surface 124 of film 112 and reclosable fastener assembly 130. Each of the side seals 150, 152 connects an end 132, 134 of the reclosable fastener 130 to the inside surfaces 124, 124' of the rectangular sheet of film inwardly of liner edges 114, 116 of the liner body 102 thereby preventing air or liquids from entering or leaving the liner through the ends 132, 134 of the reclosable fastener assembly 130. Preferably, prior to sealing of reclosable fastener 130 to front wall 108 and/or back wall 110, the ends 132, 134 of reclosable fastener 130 are splotched or compression molded. Splotching of reclosable fastener ends 132, 134 creates substantially flattened ends 162, 164 which facilitate the formation of the airtight and/or watertight seals of the invention. It is appreciated that these side seals substantially reduce the risk of contamination of the contents of bag liner body 102.

It is appreciated that reclosable fastener assembly 130 can take many forms. Preferably, profile strips 136, 138 are each made from a single, extruded, flexible polymeric material. Further, tearoff tabs 172, 174 can be added to walls 108, 110 above to assist in placing of liner 100 in bottle 200.

Properly feeding, locating and sealing reclosable fastener 130 at predetermined locations on the material from which the liner body 102 is made are important aspects of the invention. Machines commercially available from Z-Patch, Inc. of Carbondale, Ill. are reliable and capable of repeatedly performing the steps referred to in the method described above with high throughput and with low cycle times.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A baby bottle liner constructed and arranged to fit into a substantially rectangular cavity of a baby bottle, said baby bottle liner comprising: a continuous, profiled, elongated reclosable fastener, said continuous, profiled, elongated reclosable fastener having a first continuous elongated profile strip and a second continuous elongated profile strip, said first continuous elongated profile strip and said second continuous elongated profile strip being dimensioned, sized, positioned, and structurally constructed and arranged to provide an airtight and/or watertight seal upon interconnection thereof.

2. The baby bottle liner of claim 1 further comprising gussets.

3. The baby bottle liner of claim 1 further comprising airtight and/or watertight side seals sealing the ends of said continuous reclosable fastener to the inside walls of said liner, and airtight and/or watertight seals sealing said profiles to said inside walls.

4. The baby bottle liner of claim 1 in which each of said profile strips have at least two hooks thereon.

5. The baby bottle liner of claim 4 in which said hooks on said first continuous elongated profile strip, or optionally said hooks on said second continuous elongated profile strip, are adjacent to each other.

6. The baby bottle liner of claim 5 in which at least one of said hooks is at an end of said first continuous elongated profile strip.

7. The baby bottle liner of claim 6 in which a second hook of said two hooks is located proximal to said hook at said end of said first continuous elongated profile strip.

8. The baby bottle liner of claim 7 further comprising a plurality of continuous recesses along a length of each said profile strip, at least one of said recesses being dimensioned to resealably mate with one of said hooks.

9. The baby bottle liner of claim 8 in which at least two of said continuous recesses are dimensioned to resealably mate with said hooks.

10. The baby bottle liner of claim 9 further comprising at least one continuous recess on each said profile strip not dimensioned to mate with said hooks.

11. The baby bottle liner of claim 10 further comprising at least one protuberance along a length of each said profile strip dimensioned to fit securely in said one continuous recess on each said profile strip not dimensioned to mate with said hooks.

12. The baby bottle liner of claim 11 further comprising a plurality of ridges on a back side of each of said profile strips.

13. The baby bottle liner of claim 4 in which at least one of said hooks on said first continuous elongated profile strip is located near the center of said profile strip.

14. The baby bottle liner of claim 13 in which said hooks are symmetrically distributed on two sides of a center axis of said profile strip.

15. The baby bottle liner of claim 1 further comprising infant formula therein.

16. The baby bottle liner of claim 1 further comprising a top end seal above said reclosable fastener.

17. A baby bottle comprising the baby bottle liner of claim 1.

18. The baby bottle liner of claim 1 in which said liner comprises a microwavable plastic.

19. The baby bottle liner of claim 1 in which said liner comprises an additive that changes color when the temperature of the contents of the liner increases, whereby the temperature of the contents of the liner can be visually determined.

20. The baby bottle liner of claim 1 in which said continuous, profiled, elongated reclosable fastener is a flanged reclosable fastener.

21. The baby bottle liner of claim 1 in which said continuous, profiled, elongated reclosable fastener is a flanged reclosable fastener, and in which said flanged fastener comprises at least two flanges, each said flanges being sealed to a front wall and/or a back wall of said baby bottle liner.

22. The baby bottle liner of claim 1 further comprising tabs disposed on a front wall and/or a back wall of said baby bottle liner.

23. A kit for infant nursing comprising a plurality of baby bottle liners, said baby bottle liner comprising a continuous, profiled, elongated reclosable fastener, said continuous, profiled, elongated reclosable fastener having a first continuous elongated profile strip and a second continuous elongated profile strip, said first continuous elongated profile strip and said second continuous elongated profile strip being dimensioned, constructed and arranged to provide an airtight and/or watertight seal upon interconnection thereof.

24. The kit of claim 23 further comprising a baby bottle.

25. The kit according to claim 23 further comprising infant formula.

* * * * *